US006041536A

United States Patent [19]

Samuels et al.

[11] Patent Number: 6,041,536

[45] Date of Patent: Mar. 28, 2000

[54] SECURITY LOCK FOR REVOLVER TYPE HANDGUNS

[76] Inventors: Arnold J. Samuels; Kathleen DeWein Samuels, both of 7516 Rangeview Rd., Sacramento, Calif. 95828

[21] Appl. No.: 09/335,074

[22] Filed: Jun. 17, 1999

Related U.S. Application Data

[63] Continuation-in-part of application No. 09/189,390, Nov. 10, 1998, abandoned.

[51] Int. Cl.[7] ..... F41A 17/16

[52] U.S. Cl. ..... 42/70.11

[58] Field of Search ..... 42/70.11

[56] References Cited

U.S. PATENT DOCUMENTS

| | | | |
|---|---|---|---|
| 3,360,880 | 1/1968 | Finnegan | 42/70.11 |
| 5,732,498 | 3/1998 | Arrequin | 42/70.11 |
| 5,918,403 | 7/1999 | Lurz, Jr. et al. | 42/70.11 |

*Primary Examiner*—Charles T. Jordan
*Assistant Examiner*—Denise J. Buckley
*Attorney, Agent, or Firm*—John V. Stewart

[57] ABSTRACT

A dummy cartridge is placed in the firing chamber of a revolver. A machine screw in the front of the cartridge is then turned to extend forward partly into the barrel, preventing both firing of the gun and rotation of the cylinder. The screw is turned by a key inserted through the barrel from the muzzle. The key can be stored separately from the gun, so the gun owner, knowing its location, can quickly unlock the gun, but an intruder cannot use the gun. All chambers in the revolver cylinder except one can be loaded with live ammunition, so the gun can quickly be used for self-defense after unlocking. However, if the gun is locked without live ammunition, none can be added to any chamber until the gun is unlocked, which is ideal for firearm display applications. The dummy cartridge has means to prevent its turning in the chamber, so the key will turn the screw instead of the cartridge. The key fits closely within the barrel to center the key tip and align it with the screw head for immediate coupling.

7 Claims, 3 Drawing Sheets

SECURITY LOCK FOR REVOLVER TYPE HANDGUNS

CROSS-REFERENCE TO RELATED APPLICATIONS

This application is a continuation-in-part of U.S. utility patent application Ser. No. 09/189,390, filed Nov. 10, 1998, now abandoned.

BACKGROUND OF THE INVENTION

1. Field of the Invention

This invention is in the field of safety locks for revolver type handguns.

2. Description of Prior Art

Numerous attempts have been made to devise practical safety locks for revolvers, but they have not met widespread acceptance, for reasons exemplified by the following prior patents. Some have protrusions at the muzzle and therefore are obvious to the observer. Some can be unlocked by anyone. Some are awkward and slow to set up. Many are complex and costly to manufacture. Some use materials or mechanisms in ways that are unreliable over time. Some require modification of the gun, and can only be provided as original equipment on new guns.

U.S. Pat. No. 4,048,741 (Chiodo) shows a Rotation-Preventing Lock Assembly for revolver type pistols. It is inserted into one of the firing chambers from the back, and fixed therein with a cam that is operated by a key inserted through the device from the back. This device is not aligned with the barrel, but blocks rotation of the cylinder by projecting from the back and/or front of the cylinder against the gun body. It is mechanically and operationally dissimilar to Applicants' device, and is more complex. It does not block the chamber aligned with the barrel, which can contain a live round that can accidentally discharge on some types of revolvers if the gun were dropped.

U.S. Pat. No. 4,023,294 (Knopp) shows a Safety Device for Firearms, comprising a rod that is pushed into the barrel from the muzzle, filling the barrel and firing chamber. Resilient longitudinal ribs on the rod press against the inner walls of the barrel to retain the rod in the barrel. A removable key is threaded onto the muzzle end of the rod for removal of the rod. Unlike the present invention, Knopp's device must be specialized for the barrel length of each gun. If Knopp's lock is used in a longer barrel than one for which it was designed, the rod can be inserted fully into the barrel without reaching the chamber. This would allow the gun to be fired with the rod in the barrel, not only failing to lock the gun, but creating a possibility of gun explosion.

U.S. Pat. No. 3,360,880 (Finnegan) shows a Safety Device Insertable in the Chamber of a Firearm, comprising a cylindrical casing with helical slots, a plunger extending from the casing with pins guided in the slots, and a spring urging the plunger to extend. The slots have locking seats to hold the plunger either fully extended or retracted. In the extended position the plunger blocks the gun barrel, and prevents rotation of the cylinder of a revolver. This device requires a spring, has more parts than the present invention, and has a more difficult method of use.

U.S. Pat. No. 3,072,674 (Mahan) shows a Safety Lock for Revolvers comprising a dummy cartridge with an extendable plunger in place of a bullet. The plunger is constantly urged to its extended position by a spring in the cartridge case. The dummy cartridge is inserted in a firing chamber of the cylinder. The plunger is depressed manually while rotating the cylinder, to align the dummy cartridge with the gun barrel. The plunger extends into the barrel, blocking rotation of the cylinder. To unlock the gun, a rod is inserted in the barrel to depress the plunger while the cylinder is opened for removal of the dummy cartridge. Unlike the present invention, the gun cannot be used without removing the dummy cartridge from the chamber, because the extended plunger blocks the cylinder rotation against the outer surface of the gun frame. This can cause an unacceptable delay when the gun is needed for self defense.

U.S. Pat. No. 3,022,598 (Wikstrom) shows a Safety Device for a Revolver, comprising a dummy cartridge with an extendable bullet that is continuously urged to retract into the cartridge by a spring. The bullet can be pulled forward partly into the barrel by a key inserted through the barrel. The key fits into a key-hole in the bullet, and is turned 90 degrees to interlock in the bullet. The key is then pulled forward, pulling the bullet partly into the barrel, and a clip is inserted through the shaft of the key at the muzzle to retain the key against the spring tension. To release the lock, the clip is removed, and the key is pushed inward and 90 degrees to slip it out of the key-hole. Unlike the present invention, this device requires the key to always be in the barrel of the locked gun, making it available for use by a burglar as well as the gun owner.

U.S. Pat. No. 2,530,560 (Young) shows a Safety Lock for Firearms comprising a dummy cartridge that is locked into the firing chamber by radial expansion. With this design, a dummy cartridge is required for each chamber of a revolver, making the gun useless for self-defense.

U.S. Pat. No. 2,943,411 (Salva) shows a Safety Lock for Revolvers comprising a bolt passing through a chamber of the cylinder beside the gun body, and fastened with a threaded knob. This blocks rotation of the cylinder, but does not block the firing chamber aligned with the barrel. Thus a live cartridge could be in the aligned chamber, and could accidentally discharge on some types of revolvers if the gun were dropped.

SUMMARY OF THE INVENTION

Many people keep loaded handguns accessible for protection, and wish to keep them secure from visitors, intruders, and children. An object of this handgun lock is to provide safety against unintended discharge of a loaded revolver. Another object is a handgun lock that prevents loading of an unloaded revolver. Another object is a handgun lock that can be unlocked quickly by the owner. Another object is a handgun lock which allows all chambers except the firing chamber to be loaded with live ammunition prior to locking, so that the handgun is ready to use immediately upon unlocking. Another object is a handgun lock which prevents accidental discharge due to dropping a loaded handgun on the floor. Another object is an after-market handgun lock that can be used on existing handguns without modification of the gun. Other objects include low cost and high reliability.

These objectives are realized with a dummy cartridge inserted in a chamber of the cylinder of a revolver. The blocked chamber is rotated to the firing position. A screw in the front of the cartridge can then be extended forward partly into the barrel, preventing both firing of the gun and rotation of the cylinder. The screw is turned by a key inserted temporarily through the barrel from the muzzle. The key can be stored separately from the gun, so the gun owner, knowing its location, can quickly unlock the gun, but an intruder cannot use the gun. All chambers except the firing chamber can be loaded with live ammunition, so the gun can quickly be used for self-defense after unlocking. However, if the gun is locked without live ammunition, none can be added to any chamber until the gun is unlocked, which is ideal for firearm display applications. The dummy cartridge has reliable means to prevent its turning in the chamber, so the key will turn the screw instead of the cartridge. The key fits closely within the barrel to center the key tip and align it with the screw head for immediate coupling therewith. The present invention can be made completely of non-corrosive metals, since no plastic or rubber parts are needed. It uses a positive threaded metal-to-metal lock which is highly reliable, and no parts are subject to stiffening, relaxation, or dissolution with time as with rubber and plastic.

REFERENCE NUMERALS

Figure 1:
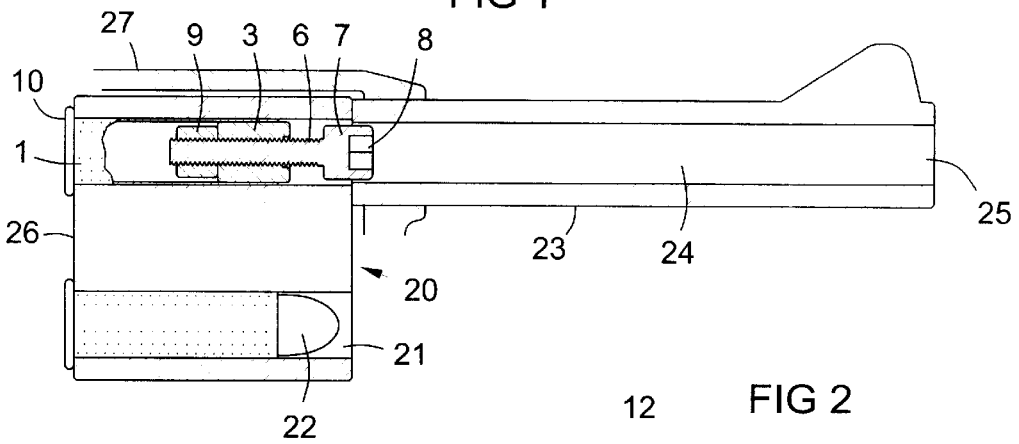
FIG. 1 is a partial side sectional side view of a revolver with the dummy cartridge in the firing chamber, in its locked position.
Figure 2:
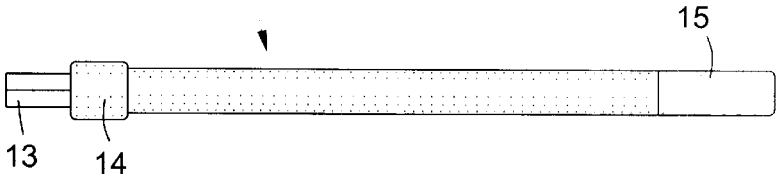
FIG. 2 is a side view of a key for turning the machine screw of the dummy cartridge.
Figure 3:
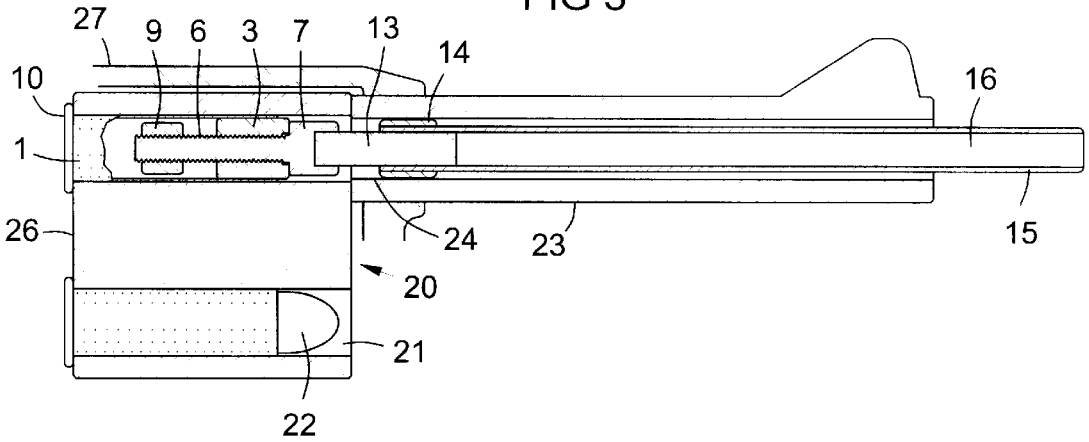
FIG. 3 is a side sectional view as in FIG. 1 in the unlocked position, with the key of FIG. 2 engaging the machine screw.

1. Dummy cartridge
2. Dummy cartridge case
3. Internally threaded insert in front end of dummy cartridge
4. Depression in threaded insert to avoid binding of screw
5. Machine screw
6. Threaded shaft portion of machine screw
7. Head on front end of machine screw
8. Socket in head of machine screw
9. Retainer on shaft of screw
10. Back end of dummy cartridge case
11. Axis of dummy cartridge case
12. Key
13. Tip of key
14. Collar of key
15. Grip of key
16. Shaft portion of key
17. Out-of-round portion of case
18. Elongated slot in case
19. Raised portion of case between slots for elastic interference fit in chamber
20. Conventional revolving cylinder of handgun for holding cartridges
21. Conventional cartridge chamber of revolving cylinder
22. Conventional bullet
23. Conventional barrel of handgun
24. Conventional bore of handgun barrel
25. Conventional muzzle of handgun barrel
26. Breech end of cylinder
27. Conventional frame of handgun (partially shown)

DESCRIPTION

The invention is a dummy cartridge in the shape of a bullet cartridge, which is inserted into the cylinder of a revolver via the breech, and blocks revolution of the cylinder. This renders the revolver inoperable, whether it is loaded or unloaded.

Figure 4:
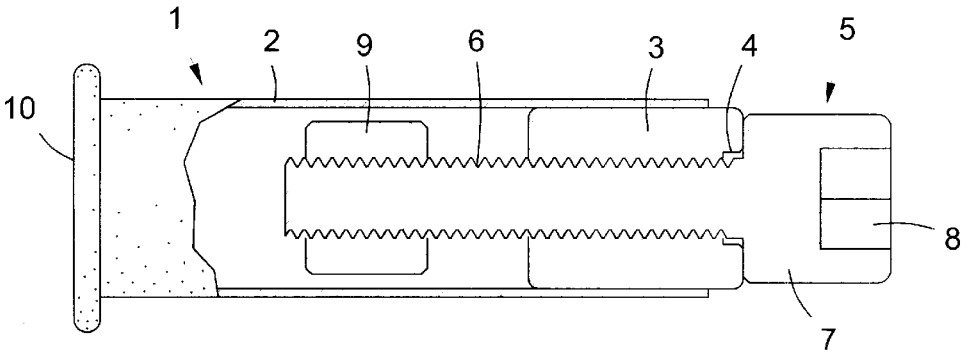
FIG. 4 is an enlarged sectional view of the dummy cartridge.
Figure 5:
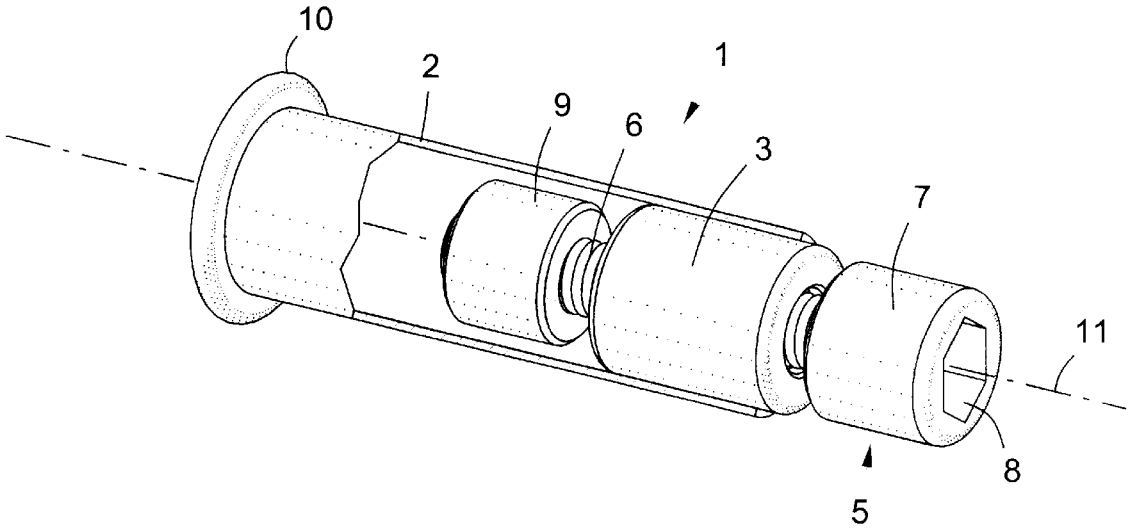
FIG. 5 is a perspective view of the dummy cartridge with the case (2) partly cut away.

As shown in FIG. 4, the device comprises a dummy cartridge case (2) of standard cartridge dimensions, without a bullet, primer, or powder. An internally threaded insert (3) is fitted into the front end of the case and permanently affixed therein by cinching or other means. The shaft (6) of a machine screw (5) is threaded through the insert from the front. The insert preferably has a depression (4) to prevent binding with the base of the threaded shaft. The front end of the machine screw has a head (7) with a smaller diameter than the caliber of the gun. The head has a socket, which is shaped to receive the tip of a key type wrench (12), such as an alien wrench.

The back end of the machine screw shaft has a retainer (9) which prevents removal of the machine screw from the threaded insert. The retainer preferably takes the form of a threaded nut which is frozen onto the shaft by means such as a set-screw, cinching, or adhesive. It may optionally take another form, such as a circular clip. The retainer is of smaller diameter than the inside of the dummy case, allowing the retainer to turn freely with the screw shaft without contacting the case. It stops extension of the machine screw in a position with the screw head projecting into the bore of the gun to securely block revolution of the cylinder.

The dummy cartridge is placed in one of the cartridge chambers (21) of the gun cylinder (20). The key (12) has a shaft (16) long enough to pass through the gun barrel (23) from the muzzle to reach the machine screw socket. The key shaft optionally has a collar (14) which centers and aligns the shaft in the gun barrel. This allows quick mating of the key tip (13) with the socket (8) without blind searching. The key tip and socket can have any conventional mating shape used for threaded fasteners and their respective tools, such as hexagonal or phillips. However, they preferably have a mating shape and/or size that is incompatible with most or all conventional screw drivers and key wrenches. This prevents unlocking of the gun with common tools. A slightly tapered mating shape is suggested for the best engagement speed. The grip portion of the key shaft can be knurled as shown, or if can have a wing or lever. Optionally, the machine screw head can have the male part, and the socket can be on the wrench tip. In this design, the socket shell on the key tip can fit closely in the bore to align the mating parts so a collar is not needed on the key.

The security lock is actuated by placing the dummy cartridge, with its machine screw retracted, into one chamber of the cylinder via the breech end of the gun. With the machine screw retracted, the entire length of the dummy cartridge is approximately equal to the length of the live ammunition it replaces. The remaining chambers of the cylinder may be loaded with live ammunition to lock a loaded gun, or may be left empty to lock an unloaded gun.

The cylinder is then closed so that the dummy cartridge is in line with the bore of the gun. The key is inserted through the muzzle, through the bore, and into the socket of the machine screw. The key is turned to extend the machine screw forward until its head enters the bore. The retainer then contacts the back of the threaded insert, stopping further extension of the machine screw. The key may then be removed, and stored with the gun, or it may be stored elsewhere for additional security.

Figure 6:
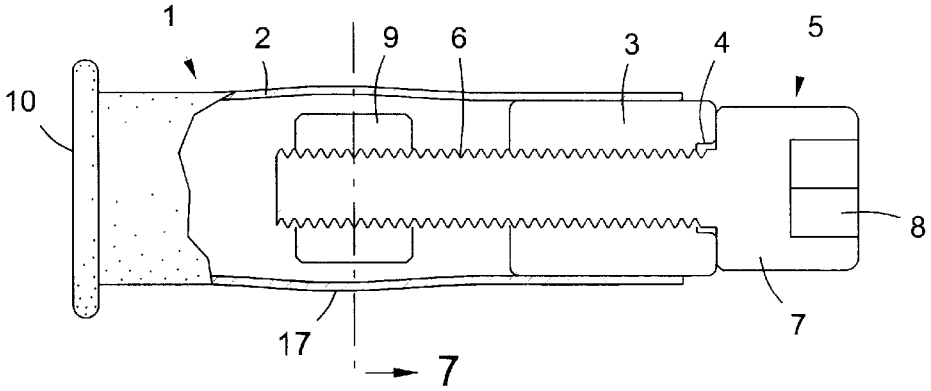
FIG. 6 is a side sectional view of the dummy cartridge with an out-of-round middle portion (17) for interference against the firing chamber, exaggerated for clarity.
Figure 7:
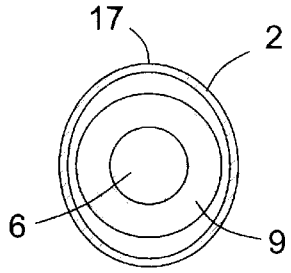
FIG. 7 is a cross sectional view of FIG. 6 taken along line 7 showing the preferred elliptical mid-section of the case (the ellipse is exaggerated for clarity).
Figure 8:
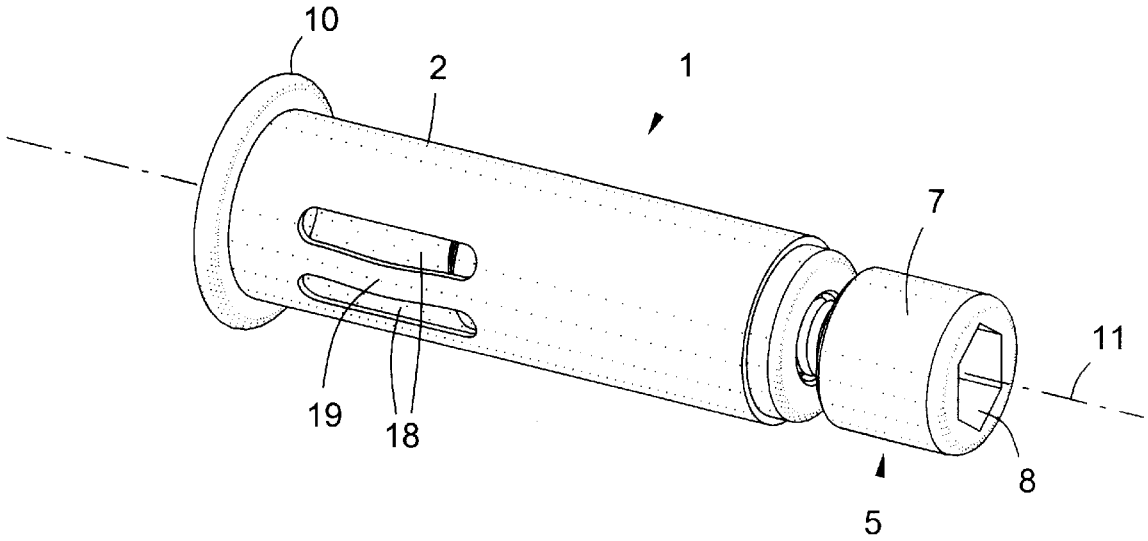
FIG. 8 is a perspective view of the dummy cartridge with slots 18 and raised portion 19 for elastic interference fit in firing chamber.

While turning the machine screw, the threaded insert is prevented from turning by friction of the dummy cartridge against the firing chamber. This friction may be enhanced. Preferably the mid-section of the dummy cartridge is made slightly out-of-round as shown in FIGS. 6 and 7 (exaggerated for clarity). This can be done by squeezing the mid-section of the cartridge past its elastic limit after assembly. The cartridge then exerts an outward spring force against the inner walls of the chamber, increasing its resistance to rotation in the chamber. The elasticity of this interference can be increased by adding one or more longitudinal slots beside and/or within the bulging areas of the cartridge case. In FIG. 8 two slots are shown in the case, with a raised portion of the case between the slots for this purpose. The machine screw retains its position in the threaded insert by normal thread friction. With the machine screw extended, the cylinder cannot turn, therefore a real cartridge cannot be aligned with the bore for firing.

A handgun secured with this device is unable to fire immediately or accidentally. Thus it prevents or delays the efforts of an unauthorized person to fire the gun. Such person must locate and recognize the special key to unlock the device, or must have a matching wrench such as an allen key with a long shaft. This latter option can be prevented by using a non-standard key and socket shape. A child finding the gun cannot discharge it. If an intruder finds the gun before the owner can reach it, the intruder cannot use it to assault the owner. Yet a legitimate operator can quickly retract the extended machine screw by using a special wrench or key. Once fully retracted, the machine screw no longer blocks revolution of the cylinder, and the gun can be immediately fired without further preparation. Thus, in storage, as well as in emergency situations, the lock provides an advantage to the owner. With the security lock in place, an unloaded revolver cannot be loaded. This is useful to anyone who stocks and displays revolvers, such as gun collectors and gun shops.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

We claim:

1. A security lock for a handgun having a firing chamber with a predetermined length in a rotatable cylinder, the lock comprising:

a dummy cartridge having an axis and a front end;

the front end of the cartridge having helical internal machine threads coaxial with the axis of the cartridge;

a machine screw having a shaft with helical external machine threads threaded into the internal machine threads;

the screw having a front end projecting forward from the dummy cartridge;

the screw having a predetermined range of threaded movement in the dummy cartridge for adjusting the combined length of the dummy cartridge and the screw between shorter than the firing chamber and longer than the firing chamber;

a key having an elongated shaft with first and second ends;

a grip on the first end of the key shaft;

a tip on the second end of the key shaft for turning the screw;

whereby the dummy cartridge can be inserted into the firing chamber, and the screw can be extended and retracted by turning it with the key, to respectively lock and unlock the handgun.

2. The security lock of claim 1, wherein the cartridge includes a generally cylindrical case with a portion that is out-of-round sufficiently to provide an elastic interference fit in the firing chamber; whereby the dummy cartridge can be pushed into the firing chamber, and resists turning in the chamber.

3. The security lock of claim 1, wherein the cartridge includes a generally cylindrical case with at least one pair of substantially parallel elongated slots substantially aligned with the axis, and a portion of the case between the two slots is radially distended away from the axis, providing elastic interference in the firing chamber, whereby the dummy cartridge can be pushed into the firing chamber, and resists turning in the chamber.

4. A method for locking a handgun having a barrel with a muzzle and having a firing chamber aligned with the barrel in a rotatable cylinder, comprising the steps of:

a) providing a dummy cartridge having a front end with helical internal machine threads;

b) providing a machine screw with helical external machine threads threaded in the internal threads and projecting forward from the front end of the cartridge;

c) providing an elongated key with a tip for rotating the screw;

d) inserting the dummy cartridge into the firing chamber;

e) inserting the key into the barrel of the revolver from the muzzle;

f) turning the screw with the key tip until the screw projects from the dummy cartridge partly into the barrel of the handgun;

whereby the firing chamber is blocked by the dummy cartridge, and rotation of the cylinder is prevented.

5. A security lock for a handgun having a firing chamber in a rotatable cylinder, comprising:

a key having an elongated shaft with first and second ends, the first end having a tip, and the second end having a grip for manual turning of the key;

a dummy cartridge having a cartridge case with front and back ends and an axis;

the back end of the cartridge case having a rim;

an insert fixed in the front end of the cartridge case, the insert having front and back ends;

internal helically advancing threads passing through the insert along the axis of the cartridge case;

a machine screw having a shaft with external helically advancing threads and front and back ends;

the screw shaft threaded through the insert and extending from both the front and back ends of the insert;

the front end of the screw shaft having a head that receives the tip of the key for rotation of the screw by the key; and the back end of the screw shaft having a retainer that blocks removal of the screw from the threaded insert.

6. The security lock of claim 5 wherein the cartridge case has a generally cylindrical cross section with a portion that is out-of-round sufficiently to provide an elastic interference fit in the firing chamber, whereby the dummy cartridge can be pushed into the firing chamber, and resists turning in the chamber.

7. The security lock of claim 5 wherein the cartridge case has at least one pair of substantially parallel elongated slots aligned with the axis, and a raised portion of the case between the two slots providing elastic interference of the cartridge in the firing chamber.

* * * * *